US005738161A

United States Patent [19]

Martin

[11] Patent Number: 5,738,161

[45] Date of Patent: Apr. 14, 1998

[54] ROLL UP DOOR

[75] Inventor: John C. Martin, Toronto, Canada

[73] Assignee: Diesel Equipment Limited, Ontario, Canada

[21] Appl. No.: 711,205

[22] Filed: Sep. 9, 1996

[51] Int. Cl.[6] ..... E05D 15/06

[52] U.S. Cl. ..... 160/201; 160/231.1; 160/230

[58] Field of Search ..... 160/201, 188, 160/189, 229.1, 230, 231.1, 231.2

[56] References Cited

U.S. PATENT DOCUMENTS

| | | | |
|---|---|---|---|
| 1,916,651 | 7/1933 | Beeman et al. | 160/189 |
| 2,789,636 | 4/1957 | Lawick | 160/188 |
| 2,909,718 | 10/1959 | Lawick | 160/188 X |
| 3,017,218 | 1/1962 | Groth et al. | 160/201 X |
| 3,129,752 | 4/1964 | Whiting | 160/201 |
| 3,336,968 | 8/1967 | Curtis | 160/188 |
| 3,870,391 | 3/1975 | Nims | 160/230 X |
| 4,811,777 | 3/1989 | Chretien | 160/201 |
| 4,860,813 | 8/1989 | Ballyns et al. . | |
| 4,893,666 | 1/1990 | Hormann | 160/201 X |
| 5,056,847 | 10/1991 | Stillwell et al. | 160/188 X |

*Primary Examiner*—David M. Purol
*Attorney, Agent, or Firm*—Oliff & Berridge, PLC

[57] ABSTRACT

A roll up door which may be used in the back of a van body has a plurality of panels arranged edge-to-edge with a thin flexible sheet glued to the outside face of the panels and a flexible belt attached to each pair of adjacent panels at the rear face of these panels. A roller extends from each end of each panel and is received by a generally inverted L-shaped guide track. With this arrangement, the panels may cant while moving from the vertical to the horizontal leg of the guide channels by virtue of the belts which hinge and collapse allowing the outer sheet to bend as well.

9 Claims, 3 Drawing Sheets

ROLL UP DOOR

BACKGROUND OF THE INVENTION

1. Field of the Invention

This invention relates to a roll up door and a up door system.

2. Description of the Related Art

U.S. Pat. No. 4,860,813 to Ballyns discloses a roll up door for the back of a van body. The door comprises a plurality of panels joined together by hinges. A guide track is positioned at either end of the door and rollers extending from the hinges are received by the guide tracks. The door is manually operated and a counterbalancing spring mechanism attached proximate the top of the door moderates the closing of the door.

A difficulty with a roll up door of the type described is that a load in a van could shift against the door and interfere with the hinges making opening of the door difficult. Furthermore, the outside corners of the panels of such a door typically degrade with time and dirt may lodge between adjacent panels. For these reasons, the appearance of the door becomes less appealing with time.

This invention seeks to overcome drawbacks associated with known roll up doors.

SUMMARY OF THE INVENTION

In accordance with the present invention, there is provided a roll up door system, comprising: a roll up door having a plurality of panels in spaced edge-to-edge relation; a flexible sheet having a face which is adjacent an outer face of each of said panels, said sheet joined to each of said panels; and a flexible means adjacent an opposite, inner, face of each of said panels and joined to each pair of adjacent panels; a pair of guide channels; and a roller extending from each end of each of said panels, with rollers extending from a given end of said panels being received within one of said guide channels.

BRIEF DESCRIPTION OF THE DRAWINGS

In the figures which illustrate an example embodiment of the invention.

DETAILED DESCRIPTION OF THE PREFERRED EMBODIMENTS

Figure 1:
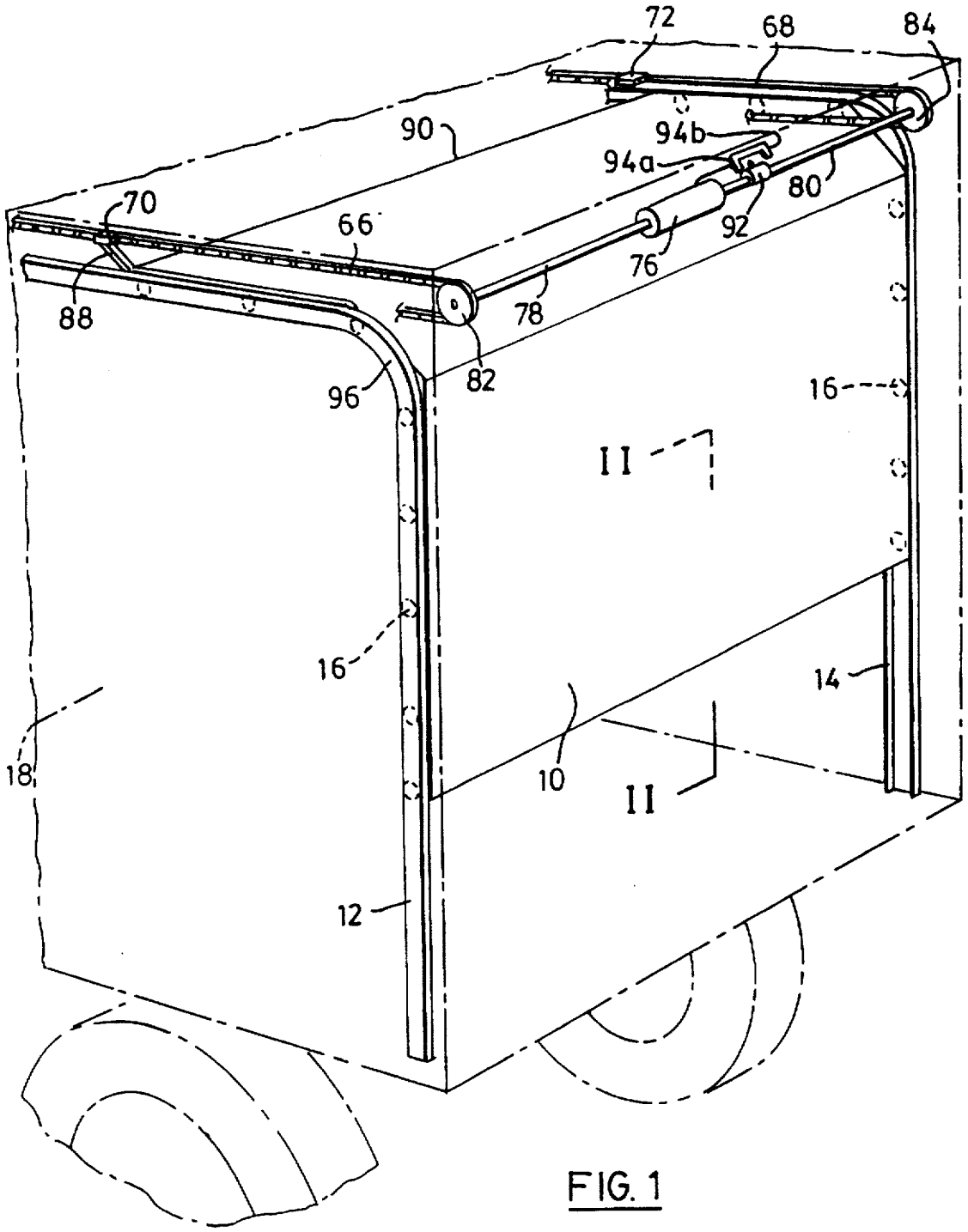
FIG. 1 is a simplified perspective view of a van equipped with a roll up door system made in accordance with this invention.

Turning to FIG. 1, a roll up door 10 made in accordance with this invention is slidably mounted to generally inverted L-shaped guide channels 12 and 14 by rollers 16 which extend from either end of the door and are received by the guide channels. The guide channels are mounted at the back of a van body shown in phantom at 18.

Figure 2:
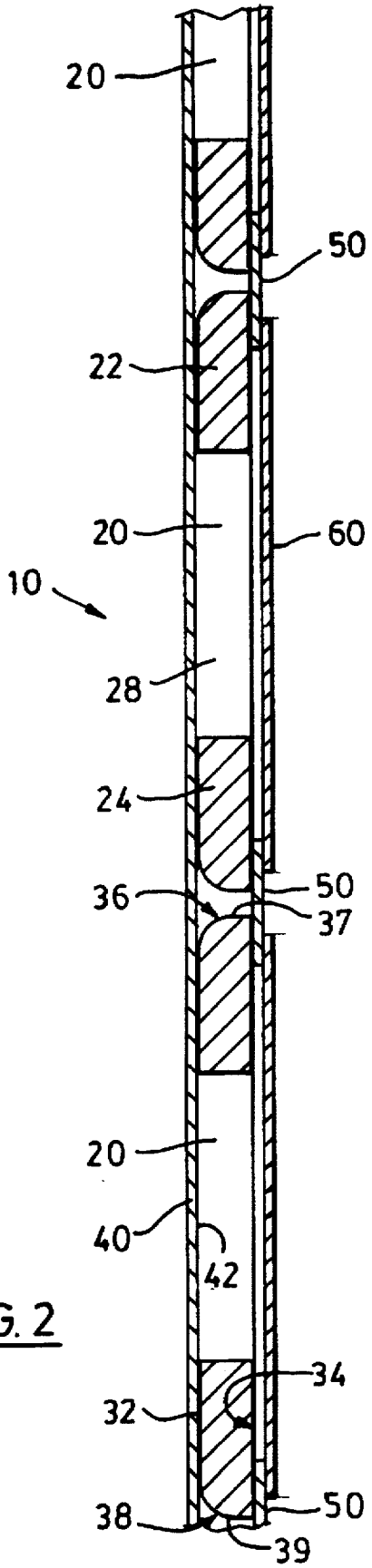
FIG. 2 is a cross-sectional view along the lines II—II of FIG. 1.
Figure 3:
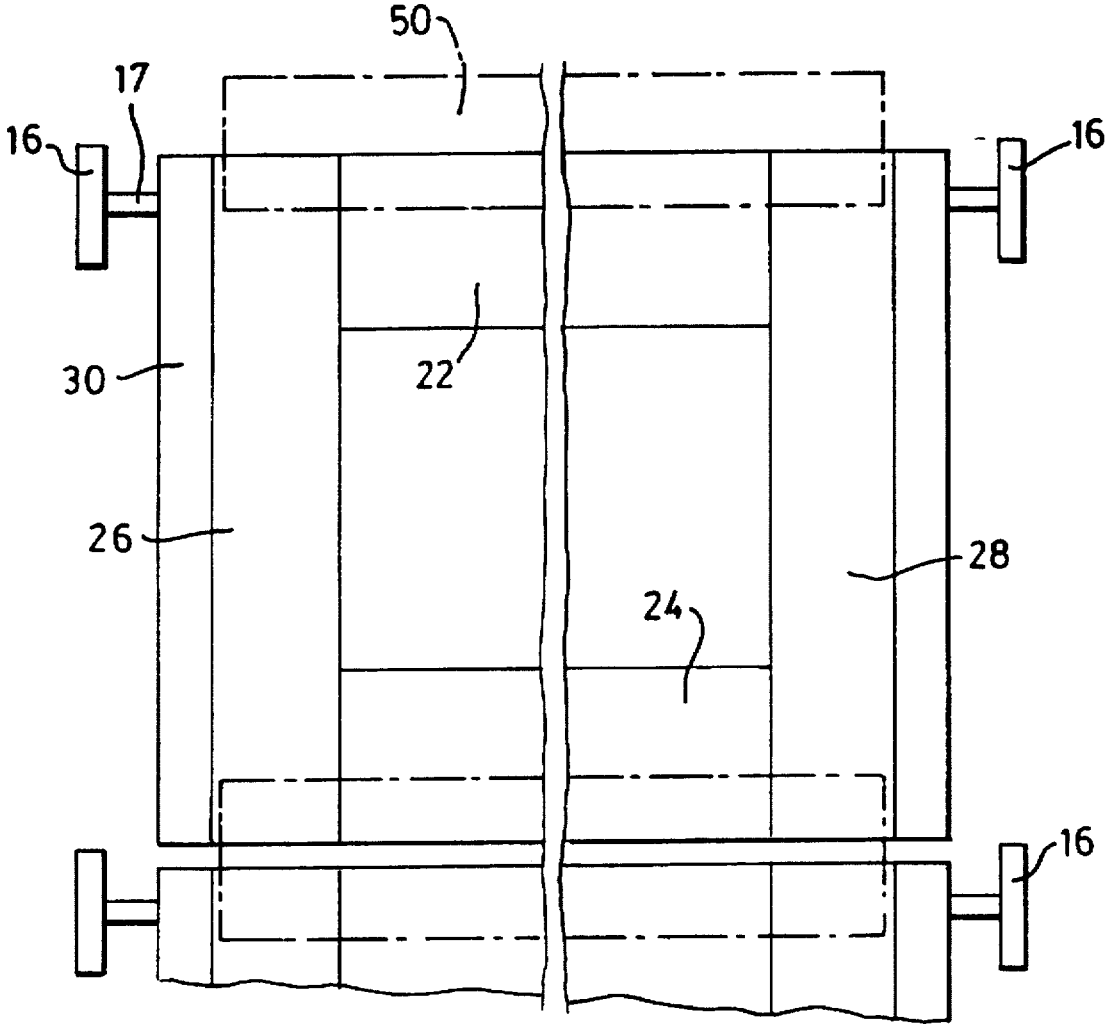
FIG. 3 is a back view of a portion of the roll up door shown in FIG. 1.

Turning to FIG. 2, it will be seen that the roll up door 10 comprises a plurality of panels 20 in spaced edge-to-edge relation. Referencing FIG. 3 as well as FIG. 2, each panel 20 is in the form of a rectangular frame with a top frame member 22, a bottom frame member 24 and end frame members 26 and 28. A metal web 30 is mounted to each of the end members and supports a roller 16. The frame members of each panel 20 may be made of laminated wood.

A thin flexible sheet 40 (shown in FIG. 2 but not in FIG. 3) has an inside face 42 which is positioned adjacent the outside faces 22 of the panels 20 and is glued thereto. The flexible sheet 40 may be made of thin woven FIBERGLASS™.

A flexible belt 50 bridges each pair of adjacent panels and is joined to the inner faces 34 of the panels. Each belt 50 may be manufactured as a woven textile ribbon. Referring solely to FIG. 2, a backing panel 60 is joined to the inside face 34 of each panel. Preferably, each backing panel is stapled to a panel 20 through belts 50 so that the backing panel holds the belts in place. The backing panel closes the central opening between panel frame members 22, 26, and 28.

Each panel is radiused at 36 from the outside face 32 of the panel to the top edge 37 of the panel and at 38 from the outside edge 32 of the panel to the bottom edge 39 of the panel.

Figure 4:
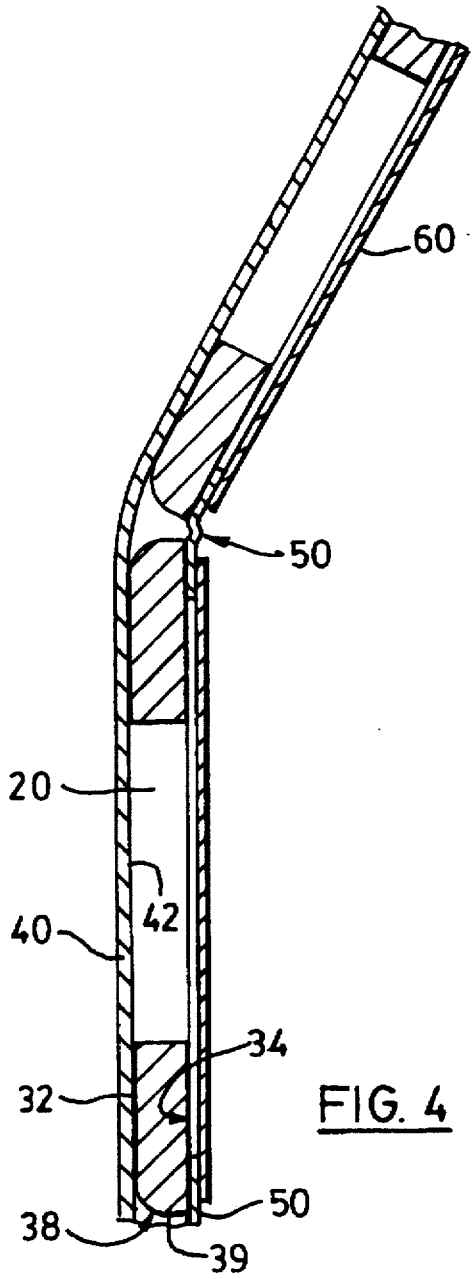
FIG. 4 is a cross-sectional view of the roll up door of FIG. 2 shown in a hinged position.

As illustrated in FIG. 4, roll up door 10 may be hinged at a belt 50 such that the belt acts as an inner hinge and the flexible sheet 40 as an outer hinge. It will be noted from FIG. 2 that a belt 50 is taut when two panels to which it is attached are vertically oriented and from FIG. 4 that the belt 50 collapses as the panel thereabove hinges from a vertical position.

Returning to FIG. 1, the roll up mechanism for door 10 comprises two endless chains 66, 68 located above door 10, each chain supporting a chain block 70, 72, respectively. An electric motor 76 is coupled by shafts 78 and 80 to sprockets 82 and 84, respectively, for driving the endless chains 66, 68 in order to linearly move the chain blocks 70, 72. A link arm 88 extends from each chain block 70, 72 and terminates in an eye 89 (FIG. 5) by way of which the link arm is pivotally Joined to the support shaft 17 (FIG. 3) of the roller 16 most proximate at the top edge 90 of door 10. A part ion of shaft 80 is threaded and supports a worm 92 with a finger which extends between limit switches **94*a*, 94*b*. The limit switches are connected to a control input of motor 76. Through a further control input (not shown) an operator may activate motor 76** in a forward or reverse direction.

In operation, an operator may activate motor 76 to move endless chain 66, 68 so that blocks 70, 72 translate toward the front of the van body 18. This raises door Referencing FIG. 4 as well as FIG. 1, as the rollers 16 of a panel 20 reach the curved portion 95 of the guide tracks 12 and 14, the panel is guided from a vertical to a horizontal orientation. As this occurs, the panel will hinge with respect to the next adjacent panel beneath it at the belt 50 between the panels. When the door reaches its fully up position, the finger of worm 92 abuts limit switch **94*b* which sends a control signal to motor 76 in order to stop same. To close the door, the operator activates motor 76 to rotate in the opposite direction. This causes blocks 70, 72 to translate toward the rear of the van body 18. In so doing, the link arms 88 push the rollers 16 to which they are pivotally joined causing the door to descend. When the door reaches its closed position, the finger of worm 92 abuts limit switch 94*a* which shuts off motor 76**.

Since outer sheet 40 is continuous, it provides a smooth clean line appearance to the roll up door and is readily adapted for painting. Also, since the space between each pair of adjacent panels 20 is closed by the sheet 40 and a backing belt 50, no dirt may enter this space and, further, the top bottom edges of the panels 20 are protected from other degrading influences of the environment.

It will be apparent that the roll up door 10 could be raised even if a lead abutted the rear of the door because the lead would not catch on the belts 50 nor any other portion of the door.

Figure 5:
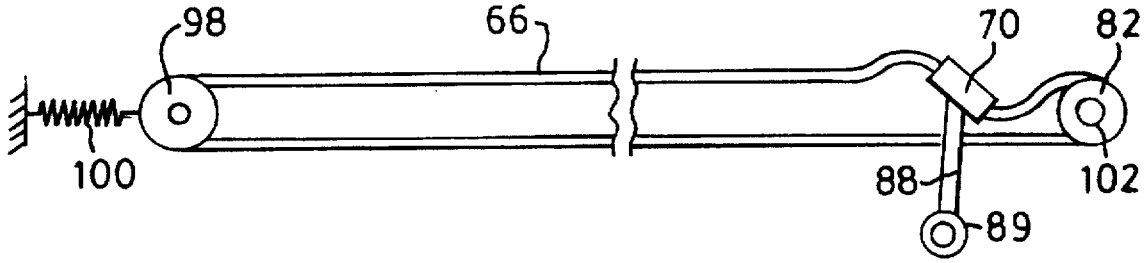
FIG. 5 is a schematic side view of a portion of a door control mechanism.

Turning now to FIG. 5 which illustrates an enhancement for the invention, the forward sprocket 98 of endless chain 66 may be attached to the van body by spring 100. With this enhancement, the limit switch 94*a* may be positioned so that the chain 66 continues to translate chain block 70 until the block assumes the position illustrated in FIG. 5 whereat link arm 88 has rotated overcentre. Endless chain 68 would be similarly equipped. The driving of the link arms 88 to an overcentre position provides a lock for door 10 in the closed position.

Sprocket 82 may be provided with hex nut end 102. A (lockable) opening in the rear portion of the van body may then be provided so that door 10 could be manually raised should motor 76 fail by first opening the lockable opening and then inserting an appropriate hex wrench to manually rotate the sprocket wheel 82.

Other modifications will be apparent to those skilled in the art and, therefore, the invention is defined in the claims.

What is claimed is:

1. A roll up door system, comprising:

a roll up door having plurality of panels in spaced edge-to-edge relation;

a flexible sheet having a face which is adjacent an outer face of each of said panels, said sheet joined to each of said panels such that said sheet acts as an outer hinge for said plurality of panels;

a pair of generally inverted L-shaped guide channels, each having a linear lower section, a curved middle section and a linear upper section;

a roller extending from each end of each of said panels, with rollers extending from a given end of said panels being received within one of said guide channels;

a flexible belt joined to each pair of adjacent panels at an inner face of each panel of said each pair of adjacent panels arranged such that when said rollers of said pair of panels to which said flexible belt is joined ride in said lower section of said guide channels, said flexible belt is taut and when the rollers of one of said pair of panels to which said flexible belt is joined ride in said lower section of said guide channels and another of said pair of panels to which said flexible belt is joined ride in said middle section or said upper section of said guide channels, said flexible belt is collapsed, whereby said flexible belt acts as an inner hinge.

2. The system of claim 1 including an operator controlled linearly moveable support and a link arm extending from said support and pivotally joined to said door proximate a top of said door.

3. The system of claim 2 wherein each of said rollers have a support shaft and wherein said link arm is pivotally joined to a support shaft of one of said rollers.

4. The system of claim 3 wherein said linearly moveable support comprises a block carried above said door by an endless chain and including a motor for driving said endless chain.

5. The system of claim 1 wherein each panel is radiused from said outside face of the panel to a bottom edge of the panel and from said outside face of the panel to a top edge of the panel.

6. The system of claim 4 wherein said endless chain is proximate one of said guide channels and including a further endless chain proximate another of said guide channels, said further endless chain carrying a block from which a further link arm extends and is pivotally mounted to a support shaft of another of said rollers.

7. The system of claim 2 wherein said flexible means comprises a flexible belt joined to each pair of adjacent panels.

8. The system of claim 4 wherein said endless chain is supported at one end by a spring whereby said block may be driven to a position whereat said link arm rotates overcentre to lock said door in a closed position.

9. The system of claim 4 wherein said endless chain comprises a sprocket, said sprocket having a nut fixed thereto for manual driving of said chain.

* * * * *